United States Patent [19]

Clayton

[11] 4,293,584

[45] Oct. 6, 1981

[54] METHOD OF PLATING WITH A PORTABLE MECHANICAL PLATER

[76] Inventor: Erith T. Clayton, 3100 Elm Ave., Baltimore, Md. 21211

[21] Appl. No.: 112,108

[22] Filed: Apr. 14, 1980

[51] Int. Cl.[3] ..... C23C 17/00

[52] U.S. Cl. ..... 427/11; 427/429; 427/445; 118/76; 118/244; 118/259

[58] Field of Search ..... 401/286, 287, 337; 427/11, 47, 127, 192, 191, 292, 328, 445, 429; 118/76, 244, 259

[56] References Cited

U.S. PATENT DOCUMENTS

| | | | |
|---|---|---|---|
| 3,132,043 | 5/1964 | Clayton | 427/242 |
| 3,700,505 | 10/1972 | Kanter | 427/11 |
| 4,202,915 | 5/1980 | Clayton | 427/11 |

FOREIGN PATENT DOCUMENTS

| | | | |
|---|---|---|---|
| 2309336 | 8/1974 | Fed. Rep. of Germany | 427/11 |
| 863087 | 3/1961 | United Kingdom | 427/11 |

*Primary Examiner*—Ralph S. Kendall

*Attorney, Agent, or Firm*—Larson and Taylor

[57] ABSTRACT

This invention relates to portable apparatus capable of being transported to a work site and which uses mechanical energy to lay down on a surface a solid metallurgically integrated massive metal coating that cannot be confused with paints, sprays or the like. The coating can be compared with hot dip galvanized coatings or electroplate coatings and done in tumbling barrels in industrial plants for years and sold under the trademarks Dyko and Peen Plate. The invention also relates to plating methods utilizing portable apparatus.

The invention relates to different types of apparatus useful for various purposes such as the repairing by galvanizing of small rust spots on cars, the regilding of jewelry with tiny brushes rigidly mounted or equipped with ball and socket type joints, the plating of bridges, tanks, transmission towers, structural shapes, and large scale industrial uses.

The invention also relates to the use of disposable pads especially adapted for the small time user.

22 Claims, 6 Drawing Figures

METHOD OF PLATING WITH A PORTABLE MECHANICAL PLATER

BACKGROUND OF THE INVENTION

This invention relates to a mechanical plating process and apparatus therefor. More particularly, the invention relates to an improved mechanical plating process of the type in which a tenaciously adherent metallic coating is applied on a surface of an object by subjecting metal particles to mechanical energy in a liquid medium to flatten and cold weld the metal particles to the object surface to build up a continuous adherent metallic coating on the surface. Such mechanical plating processes are described in my earlier U.S. Pat. Nos. Re. 23,861; 2,689,808; 2,640,002; 3,023,127; 3,132,043; and 3,479,209, and in my co-pending application Ser. No. 948,230, filed Oct. 3, 1978, now U.S. Pat. No. 4,202,915, which are herein incorporated by reference, and elsewhere.

The present invention relates to a portable type apparatus for depositing a variety of metal coatings using mechanical energy on metal objects. The coatings laid down with the various types of apparatus to be hereinafter described are of very high quality. The coatings are metallurgically integrated and bonded, are ductile, stand up well to hammering and should in no way be compared with paints, spray coatings or the like.

The coatings of this invention are laid down using mechanical energy in which the tool is very portable permitting the coating of objects of all sorts in situ. This portable plater to deposit solid metal coatings usually by means of a hand held apparatus is, so far as I am aware, unique. In the entire history of metal coatings on steel and other substances there has never been a hand held tool that can lay down solid metallurgically integrated coatings of top quality and desired depth of coating in very short times all without the application of electricity or of molten metal.

The National Bureau of Standards reports that metallic corrosion in the United States amounts to about seventy billion dollars annually. This is equal to approximately 4% of the gross national product. The Bureau report concludes that a substantial portion of this is avoidable.

The capability of the portable plater to lay down, not a paint, but a true galvanized metallic coating of desired depth of coating that is smooth and attractive on both small and large surfaces in very short intervals, constitutes a unique totally new means for attacking the staggering cost of corrosion not only to Americans but around the world, especially in humid, tropical countries where corrosion of metal surfaces is greatly intensified.

My co-pending application Ser. No. 948,230 is primarily directed at the plating of large areas of moving steel which must be galvanized. Such areas would be plate, strip, sheet, pipe, wire, rebars, structural shapes and the like. This work is done with a multiplicity of plating elements usually used in pairs or in sets of four or five to a plating tool, a large number of such plating tools constituting a unit and a number of units creating the plating line. What this instant invention discloses is the use of just one element of this plating line, namely one plating tool which may consist of one or a number of plating elements, brushes or the like which can be hand held, is very portable, and which may be of a variety of types all of which will hereinafter be described.

In addition, my co-pending application is directed at the chemical procedures necessary to produce extremely high rates of plating reaching desired thickness of coat in very short times. This is accomplished, for example, by control of chemical varients such as pH of solution, flocculation and the like.

The processing techniques and materials disclosed in co-pending application Ser. No. 948,230 may be similar to those used with the present portable plater. I refer to such things as control of pH and flocculation and the use of lubricants to prevent seizing, galling, etc. The present invention is directed more explicitly to a variety of types of plating tool which can be used to practice the invention. In particular, the plating tool of the present invention is portable.

BRIEF SUMMARY OF THE INVENTION

In one aspect, the invention relates to a method of mechanically applying a metal coating onto the surface of an object comprising: providing a portable plating device comprising: a housing; a mechanical plating member moveable relative to said housing and having a plating surface adapted to be urged against and moved relative to said object surface; means for moving said plating member relative to said housing with said plating surface urged against said object surface; and means for holding and guiding said device for movement by an operator over said surface, said device being portable and capable of being moved to said object for plating thereof; moving said device into operative position with said plating surface of said plating member urged against said object surface; supplying an admixture of mechanical plating promoter and particles of plating metal to said plating surface; and moving said plating member relative to said housing and relative to said object surface to provide a solid metallurgically integrated metallic coating derived from said plating metal particles onto said surface.

In another aspect the invention relates to a portable device for mechanically applying a metal coating on a surface of an object comprising: a housing; a mechanical plating member mounted on the device for movement relative to said housing and having a plating surface adapted to be urged against and moved relative to a surface of an object for mechanically applying a metal coating on said surface; means for supplying to said plating surface of said plating member an admixture comprising mechanical plating promoter and particles of a plating metal; means for moving said plating member relative to said housing with said plating surface urged against a surface of an object for mechanically applying to said object surface a solid metallurgically integrated metallic coating derived from the plating metal particles supplied to said plating surface; and means for holding and guiding said device for movement by an operator over said object surface to effect metal plating thereof, said device being portable and capable of being moved to said object for plating thereof.

In a further aspect, the invention relates to a portable device for mechanically applying a metal coating on a surface of an object comprising: a housing; a mechanical plating member mounted on the device for movement relative to said housing and having a plating surface adapted to be urged against and moved relative to a surface of an object for mechanically applying a metal coating on said surface, said plating surface comprising a plurality of plating elements with spaces therebetween said spaces forming a reservoir and containing an admixture comprising mechanical plating promoter and particles of metal to be plated on said object surface; means for moving said plating member relative to said housing with said plating surface urged against a surface of an object for mechanically applying to said object surface a solid metallurgically integrated metallic coating derived from the plating metal particles supplied to said plating surface; and means for holding and guiding said device for movement by an operator over said object surface to effect metal plating thereof, said device being portable and capable of being moved to said object for plating thereof.

In a further aspect, the invention relates to a mechanical plating member comprising a plating surface adapted to be urged against and moved relative to a surface of an object for mechanically applying a metal coating on a surface, said plating surface comprising a plurality of plating elements with spaces therebetween, said spaces forming a reservoir retaining particles of metal to be plated on said object surface, said metal particles being present in said plating member in an amount sufficient to effect plating of a substantial portion of said object surface.

In further aspect, the invention relates to a portable device for mechanically applying a metal coating on a surface of an object comprising: a housing; a mechanical plating member mounted on the device for movement relative to said housing and having a plating surface adapted to be urged against and moved relative to a surface of an object for mechanically applying a metal coating on said surface; means for supplying to said plating surface of said plating member an admixture comprising mechanical plating promoter and particles of a plating metal; means for moving said plating member relative to said housing with said plating surface urged against a surface of an object for mechanically applying to said object surface a solid metallurgically integrated metallic coating derived from the plating metal particles supplied to said plating surface; and means for retaining a supply of an admixture of mechanical plating promoter and metal particles adjacent said plating surface when the plating surface is urged against a surface of an object for mechanically applying said metallic coating thereto; means for holding and guiding said device for movement by an operator over said object surface to effect metal plating thereof, said device being portable and capable of being moved to said object for plating thereof.

DETAILED DESCRIPTION

There follows a detailed description of preferred embodiments of the invention including drawings in which.

Figure 1:
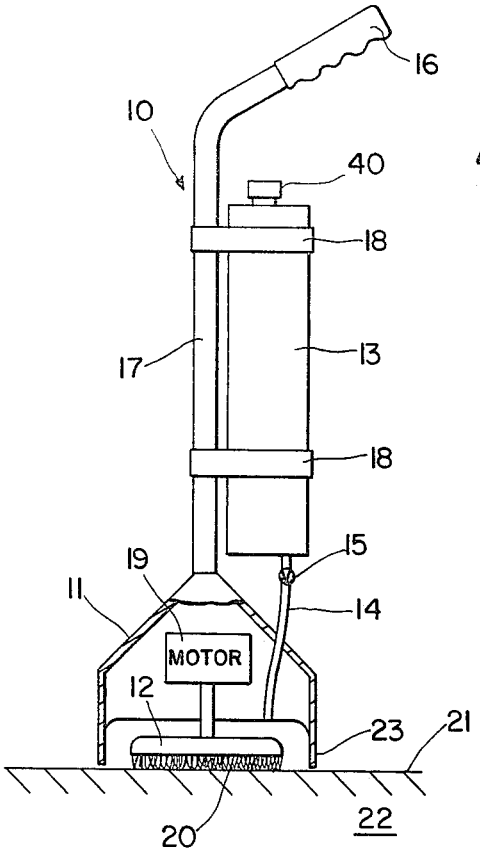
FIG. 1 is a diagrammatic side elevation view of a portable plating device in accordance with the invention.

Broadly speaking, the portable plater will cover a wide range of capabilities. On very small tools, very small brushes or pads possibly $\frac{1}{4}''$ to $\frac{1}{2}''$ in diameter are mounted on a ball and socket joint so that it can penetrate into recesses and around curves and restore jewelry and the like up to large plating tools, possibly 12" or more in diameter and consisting of a number of revolving elements attached to a hand held tool or to a portable mechanically operated tool for more accurate control.

The end user using the portable plater would be able to galvanize a farmer's barn roof that had started to rust, and large corporations would coat farm equipment, industrial equipment, fences, tanks, piping and the like. In areas subjected to heavy corrosion, special corrosion resistant alloys such as cadmium tin could be applied by the portable plater.

The types discussed will range from dipping the matted fibers into a suspension of the promoter and metal powder with or without thickening to using the matted fibers to carry the material to the surface to be plated when it is exhausted dipping it again, the operation proceeding like simple painting. From this the types will range to larger apparatus in which the operator can carry a tank on his back like a scuba diver which will feed a continuous flow of plating slurry to the plating tools. The types will encompass small tanks, apparatus like gardening spray tanks used for spraying insecticide. In other words, the tank can be put under pressure with a hand pump and the material forced out by the air pressure to the tool.

The types will encompass means for retaining and confining the solution so that it doesn't run out of the apparatus. The types will encompass apparatus using a wide variety of different kinds of brushes, matted fibers, pads and the like made of different materials such as stainless steel, brass, bronze and the like. These brushes, pads and the like will be used for different and specific purposes such as abrasively cleaning, plating and polishing. The types will encompass the use of disposable pads which can be used once and thrown away and the purchaser can buy a kit similar to those supplied with propane torches which have a variety of different size nozzles. The portable plater kit would carry a variety of plating tools and equipment for a variety of purposes.

As set out and described above, I will now describe in greater detail the variety of types of apparatus which are hand held but which may or may not be connected to a portable cart, small truck or the like which can be moved around from place to place. This disclosure does not relate specifically to the chemical procedures which are used in carrying out the invention.

These are disclosed, for example, in the U.S. patents mentioned above and in my co-pending application Ser. No. 948,230 and elsewhere.

The various types of apparatus fall into distinct types which have been mentioned above but which will now be described in detail.

This invention also discloses mechanically actuated plating tools, hand held, which are portable and can be used from place to place on a wheeled cart, vehicle or the like. This type of portable plater will primarily be used by industry for larger jobs and may easily be moved from job to job.

TYPE I

This is the paint brush procedure, namely the repetitive dipping and stirring of slurry containing the metal powder to be plated by means of brushes, pads and the like of matted fibers with or without sponges, regular brushes of various metals with or without absorbent material incorporated in the tool to retain more of the plating metal slurry. As in painting, when one load of the absorbed material is used up, in applying a metal coating, the tool is again dipped in the slurry for a fresh supply; the process being repeated until the job is done.

TYPE I-A

In this category the matted fibers, pads, brushes and the like are made from a metal wire, ribbon or the like that is not incorporated into the plate. Such metals are stainless steel, bronze, brass, steel and the like.

Some of these metals such as brass, bronze and copper will pick up a coating of the plating metal which eliminates wear of the tool because as the applied coating wears away it is reformed from the slurry. In this case the metal is transferred from the tips of the brushes or the matted fibers of the pad to the work being coated along with particles of metal powder or the like which are implanted and cold welded to form a homogenous metallurgically integrated coating.

Others like stainless steel tend not to pick up a coating and are particularly suitable for prior cleaning of the work, removal of rust or other soil. These brushes with stainless fibers or bristles can also be used for plating and they can also be used for producing a high degree of polish on the coating being deposited. They may also be used for obtaining an especially high degree of consolidation of the surface of the coating which produces an especially high quality coating.

TYPE I-B

In this type of apparatus the matted fibers, bristles and the like are of the same material as the coating metal. In this way the metal can be worn away and transferred to the surface being coated.

Many metals such as zinc do not have the right physical properties to be used as wires in the conventional type of brush but if the wires are laid not on their ends but on their sides to form an interlocking mass of fibers then the fibers can be used to coat the article to be plated.

They may, of course, be used along with regular metal powder.

TYPE I-C

As an extension of Type I-B described above, Type I-C relates to the use of disposable pads. These disposable pads would be purchased by the user for use in his portable plater. They contain everything necessary to accomplish coating. The chemicals and the metal powder or metal ribbon of the metal to be used in coating or metal in other suitable forms which could act as a binder, are compressed into a compact, absorbent pad. The pad is equipped with a fitting to be attached to the shaft of an electric drill or the like.

These disposable pads sometimes can contain absorbent material to increase the amount of material contained in the disposable pad.

These disposable pads are sealed in plastic wrappers when sold to retain the plating slurry in the form of jelly or liquid or thixotropic mixture. Alternatively, the disposable pads consist of dry chemicals together with a suitable binder, in which case the pad would either be used as a dry plater tool or could be dipped in water, or a weak organic acid solution or the like. These solutions can be supplied separately with the disposable pads which would hold the film forming surfactants and the coating metal. The acid flux being in a separate container. This would simplify the problem of manufacturing the pads.

Alternatively, if only water is used to activate the disposable pad then the fluxing material is present as a water soluble based acid salt in powdered form such as sodium acid sulfate which generates sulfuric acid when it is immersed in water. Means are provided by absorption, emulsification and the like to control the rate of acid released to the plating operation which would control the pH to produce maximum plating rates and maximum speed of plating. Since the disposable pads are included in Type I they could be used by repeated dipping of the pad in the water or the flux or in a slurry of the plating chemicals that also contains the acid flux or they may be used in Type II to be hereinafter described.

The advantage of the disposable pad would be its great convenience to the small user. The solutions would be properly mixed and retained. The bulk of the coating may come from metal such as zinc in the form of thin narrow ribbons or it may come from fine powder or from a combination of both. The ribbons wear away and contribute zinc to the coating. The ribbons are preferably the sole source of metal for coating. One of the functions of the metal in ribbon form would also be to act as a binder because these ribbons having highly active surfaces mat together very well to form a porous but strong, durable mass of interlocking ribbon. The ribbons may be of any suitable metal and are easily made as alloys directly from the molten state and chill cast at high speed.

TYPE I-D

The Type I type of apparatus is particularly suited for the use of very small brushes which would be particularly useful to the small user. For example, there may be small rusting areas in certain locations on a car. To illustrate, a Ford Thunderbird had such small rusting areas. These were abrasively cleaned with a very small brush and then were plated with zinc by repetitive dipping of a small matted metal wire brush in the plating slurry. A substantial, smooth zinc coating was thus laid down over the previously rusted area and this was then touched up with paint making a permanent invisible repair.

Again, it should be emphasized that this mechanically deposited coating is not a paint. The coatings applied to this car are solid, metallurgically integrated coatings made by a modification of the process which has been in widespread worldwide use for decades and sold under the trademarks as "Peen Plate" and "Dyko".

Such small pads or brushes work well when fitted in a ball and socket type joint so that they can be moved against curved surfaces, recessed areas, convoluted shapes such as jewelry and the like. The small size of the pads permits intimate contact in recessed areas on even very samll objects.

These very small brushes and pads lend themselves to the use of multiple units, each unit comprising elements which preferably rotate in opposite directions. Since these brushes are small, it is possible to install 2, 4 or 6 or more of them in a small space. This provides more uniform contact, and better distribution. This space between the revolving brushes can also be filled with absorbent material which will hold substantial quantities of plating slurry. The commonly used plunger for cleaning toilets is a useful general type of apparatus to contain the revolving plating tools and to prevent spillage. In modifying the plunger type the wooden handle is replaced by a metal tube attached to the plunger in place of the wooden handle. The drive shaft from, for instance, an electric drill passes through the tube. The revolving plating tools are attached to the end of the drive shaft and are within the plunger. In place of the plunger other retaining devices can be used such as a flexible bellows. A sponge or other suitable absorber is fastened to the upper surface of the flexible bellows and plating slurry is admitted at controllable rates through the hollow tube. When pressure is applied to the plunger or flexible bellows a closed container is created. The flexible bellows can be slid or moved from area to area with minimum spillage.

As in all types of Type I plating systems, the revolving plating tool can be used with each repetitive dip to stir the contents of the container, to keep the plating slurry in suspension during use.

This can be done by using an electric drill having variable speeds, for example, as the power source. In all Type I examples the power source is an electric motor with a single drive shaft or with multiple shafts as in a mixing machine like a cake mixer.

TYPE II

Type II is intended for large industrial users who expect to plate large surfaces such as bridges, transmission towers, ships, structural shapes and the like.

Type II is characterized by carrying a supply of plating slurry in a separate container which may or may not be a part of the portable plater. This is fed to the plating tool under pressure or by gravity at controlled rates.

The Type II apparatus would be much larger and would preferably consist of multiple brushes revolving in opposite directions with or without absorbent material and preferably with a rubber apron or skirt surrounding the apparatus to handle the plating slurry in the vicinity of the brushes and to minimize spillage. The amount of slurry used is quite small and normally is not a problem.

When using an apparatus such as a floor polisher on flat surfaces, a simple framework, for example, four feet square can be laid down on the flat surface to be coated to confine the solution within the framework. Since the volume of solution required is very small, this is not normally necessary but in some cases it would be a convenience. This framework may have suction pads to hold it securely to the area to be coated together with a soft rubber gasket. A small supply of plating slurry and metal powder can be retained in the enclosed barrier. The barrier preferably is made of light weight plastic or it can be of angle iron or the like for larger areas and bigger jobs. A portable tool such as a floor polisher could be moved to and fro to cover the area inside the barrier enclosure. A small amount of plating slurry would be put into the barrier. This barrier enclosure could be moved as each enclosed area is plated.

Most floor polishers come fitted with a bag or container to hold shampoo for rugs and this can be used to contain the plating promoter and acid fluxes separately or the plating metal powder can be mixed in with the promoter in the bag and can thus be fed to the revolving plating tools. The floor polisher is used as a very successful example but I have no desire to be limited in any way to any particular form such as a floor polisher.

Similarly, I have no desire to be limited in any way as to the type or kind of barrier which is made to hold the plating slurry. For example, the light weight barrier may be a part of the plating tool itself. Suitable brackets would permit its installation and removal. I do not wish to be limited in any way to means of sealing the barrier device or holding it in place. The small amount of unused material can be recliamed, for example, by a vacuum pump. In this way there is no wastage. The vacuum pump can be made a part of the floor polisher apparatus so that the plating slurry material could be pumped back into the floor polisher bag or container for reuse. In this way large areas that are flat could be covered quickly and expeditiously simply by moving the portable barrier from place to place over the surface. There may be some small overlap of coating at the joins.

Instead of the container for the plating solution being carried on a man's back or in a hand held tank, the apparatus is, when desirable, mounted on a wheeled truck or cart. This can carry a much larger supply of promoter. The truck is equipped with appropriate pumps and can be moved from place to place as the job proceeds. It will be noted that this differs from Type I which is a repetitive dipping into a container containing slurry. In Type II a continuous supply of plating slurry and metal powder is fed continuously at controlled rates to the plating tool. In this case it is more nearly analagous to the high speed continuous process described in my co-pending application No. 948,230.

Types I and II have one thing in common which distinguishes them from the high speed continuous industrial installation and that is that the actual tool itself is hand held.

In the case of a small truck or hand cart or the like having a substantial reserve supply of plating slurry then two or more individual plating tools can be operated at the same time from the same source of supply. In other words, 2, 3, 4 or more operators could be operating from a portable supply system.

Reserve tanks of the slurry can be held in convenient areas possibly in 55 gallon drums so that they could be drawn on to replenish the immediate source of supply used in the actual plating operation itself.

As to the type of container and pressure system used, I have no desire to be limited in any way to any special system. Purely by way of illustration, there is one on the market, a portable sprayer for fruit trees and the like. This is operated either by means of a pump or by means of a plunger set in an air-tight tank. The liquid is placed in the tank, usually about three-quarters full. The lid is closed and made air-tight against its gasket. The plunger is then moved manually up and down to build a substantial pressure inside the container which drives a steady flow of the liquid through a nozzle onto the fruit trees or whatever is being sprayed. This type of apparatus is usually used in a three gallon size but they also market a one gallon size which is a small and convenient tank which is easily carried and operates on the same pressure system.

By modifying the type of nozzle used, this can be locked into the plating tool in which the rotating shaft of the drill press is inside a stationary tube into which the promoter and metal powder from the tank would be conveyed. It would fall by gravity into the area of the plating brushes, pads or the like. The stationary shaft could be attached to the casing of the drill press so that it could be easily removed when not in use.

This same type of apparatus can be used for a wide variety of installations operating on the same general principle. Apparatus similar to the plating type can be used for abrasive cleaning either wet or dry. I find that stainless steel bristle brushes either wet or dry may be used for abrasive cleaning. The operation is similar to that used in the plating mode except that instead of plating promoter a suitable cleaning slurry with the appropriate fluxes, abrasives or the like would be used.

EXAMPLE NO. 1

A block of steel approximately 2½ inches square and 2 inches thick was held in a rubber gloved hand. In the other hand the operator held a small electric drill with a short shaft to which was attached a brush having brass wire which had been compressed in a vice to make a mat of fibers. This brush was dipped into a small pail containing a plating slurry and the revolving brush containing the slurry was held against each face of the steel block. The brush being dipped repeatedly in the slurry as needed. In approximately one minute all sides of the thick block of steel were galvanized with an attractive galvanized coating about 0.001" (one mil) thick.

It is noteworthy that had this block of steel been hot dip galvanized the entire piece of steel would have had to be raised above the melting point of zinc by dipping it in a bath of molten metal.

EXAMPLE NO. 2

A length of one inch diameter steel reinforcing bar (rebar) was revolved slowly in a long tank containing plating slurry. The bar had been abrasively cleaned first. Then the plating tool of Example No. 1 was dipped into the slurry of metal powder and plating promoter and moved to and fro against the revolving rebar. In a very short time it was galvanized with a very bright and shiny galvanized coat about 0.0015 inches thick. All the crevices were nicely plated. There were no unplated areas.

Had this been hot dip galvanized not only would it have had to be immersed in a bath of molten zinc but the small criss-crossing ridges would have been filled or partly filled with zinc.

EXAMPLE NO. 3

A steel plate ⅜ inch thick by 10 inches wide and 13½ inches long, approximately one square foot, was degreased then acid pickled in dilute sulfuric acid and rinsed. It was placed in a shallow flat pan with cleats on the corners to prevent it from moving. The plating tool was a floor polisher. The plating tool consisted of the two active elements rotating in opposite directions and driven by a ⅓ horsepower motor. Plating slurry containing zinc powder was added and a floor polisher equipped with brushes of brass wire was moved by hand briskly to and fro over the flat steel piece. In a matter of approximately 25 seconds the steel piece was coated with an attractive shiny galvanized coating.

In order to check the uniformity of this coating a substantial number of thickness readings were made at uniform intervals over the plated surface of this piece of steel. The thickness readings were as follows:

0.0008"; 0.00085"; 0.0008"; 0.0009"; 0.0011"; 0.0011"; 0.0011"; 0.0008"; 0.0007"; 0.0011"; 0.0011"; 0.00085"; 0.00085"; 0.0008"; 0.0008"; 0.00085"; 0.0008"; 0.0008"; 0.0008"; 0.00085". The maximum variation in thickness therefore was 0.0004".

EXAMPLE NO. 4

In a similar example a long piece of steel three inches wide and about 25 feet long was degreased and given a mild acid pickle. It was then given a copper flash. The pan of Example No. 3 which contained rollers and guides at opposite ends was covered with about ¼ inch of plating slurry containing zinc. One end of the steel strip was run through the guides and under the rollers and was pulled slowly through the pan, while the floor polisher of Example No. 3 was moved briskly to and fro across the moving piece of steel strip. In this way the steel strip was covered with a smooth galvanized zinc coating 0.001" (1 mil) thick.

In this example and in Example No. 3 the floor polisher was equipped with a plastic container designed to hold rug shampoo. This was filled with water to increase the weight of the floor polisher.

It is obvious that the thick block of steel of Example No. 1 could have been a section of a bridge girder. On a vertical or overhead section the plunger type hereinabove described may be used.

It is evident that the rebar of Example No. 2 could have been a pipe or angle iron which could be part of a transmission tower, water cistern supports and the like.

The steel section of Example No. 3 might have been part of a ship hull, a barn roof, the landing deck of an aircraft carrier, also the repair and maintenance of autos as hereinabove described.

Preferred embodiments of apparatus in accordance with the invention are illustrated in the drawings.

In FIG. 1, a portable plater according to the invention is designated 10 and is similar in appearance and construction to a floor polisher. The device includes a housing 11, a mechanical plating member 12, a reservoir 13 for supplying an admixture of plating promoter and particles of plating metal to plating member 12 via conduit 14 having a valve operable by means (not shown) readily accessible to an operator handling the device by means of handle grip 16. The plating member has a plating surface 20 adapted to be urged against and moved relative to a surface 21 of an object 22 to be plated. An upstanding member 17 interconnects the housing and the handle and provides means for supporting reservoir 13 such as by clamps 18 and for supporting a powder cord for electric motor 19 and means for actuating valve 15. Motor 19 is actuated by a switch preferably located near grip 16 for ready access. Similarly, valve 15 is preferably actuated by a member adjacent grip 16. For example, in a simple arrangement, an elongate rod (not shown) is mounted in reservoir 13 with the lower end, carrying a valve member, positioned to close conduit 15. The upper end of the rod member protrudes above the top of reservoir 13 and is provided at its upper end with a handle or the like. The conduit is opended by simply raising the rod member to a desired extent until a quantity of the admixture passes into the area of the plating element 12.

The weight of the plating device 10 urges the plating surface 20 of plating member 12 against surface 21. Extra weights may be carried by the device for this purpose. Housing 20 includes a peripheral retaining wall 23 which surrounds plating member 12 and provides means for retaining a supply or admixture adjacent to the plating member 12 and plating surface 20 thereof. The lower end of peripheral wall 23 is preferably urged against surface 21 to facilitate retention of a supply of plating materials adjacent plating surface 20.

This is readily accomplished by providing a peripheral wall 23 which is resilient in the vertical direction. Of course this urging force should be substantially less than that which urges plating surface 20 against object surface 21.

Motor 19 is actuated to move plating member 12 relative to housing 11 with plating surface 20 urged against surface 21 for plating thereof.

Frame member 17 and handle 16 provide means for holding and guiding the device for movement by an operator over the object surface to effect metal plating thereof. Thus, the device is portable and being capable of being moved to object 22, which may be massive and stationary, for plating thereof.

Although only one plating member 12 is shown in FIG. 1, it will be clear a pair of such members can be easily provided similarly as in a conventional floor polisher. In that event, the plating members preferably rotate in appropriate directions. It will also be clear that any number of plating members can be provided such as an odd number thereof or a plurality of pairs thereof.

Figure 2:
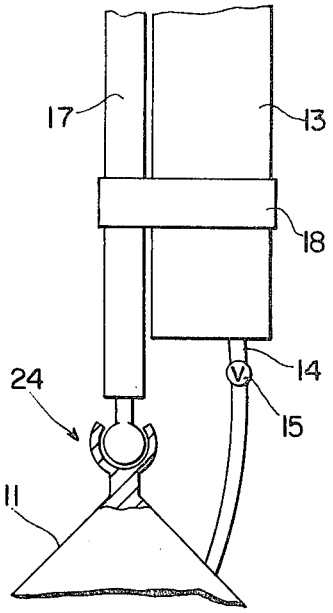
FIG. 2 is an enlarged diagrammatic side elevation view of the portion of the device according to FIG. 1.

FIG. 2 illustrates a modification applicable to embodiments of the invention in which the plating member is permitted to assume various attitudes relative to the device which allows access to object surfaces other than flat. To this end a ball and socket joint 24 may be provided adjacent the lower end of frame member 17 which interconnects plating member 12 via housing 11 and handle portion 16 by which the device is moved relative to the object surface.

Figure 3:
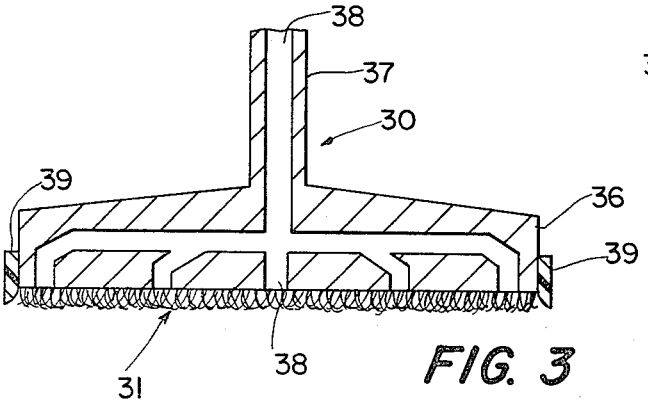
FIG. 3 is a diagrammatic cross sectional elevation view of a plating member in accordance with the invention.
Figure 4:
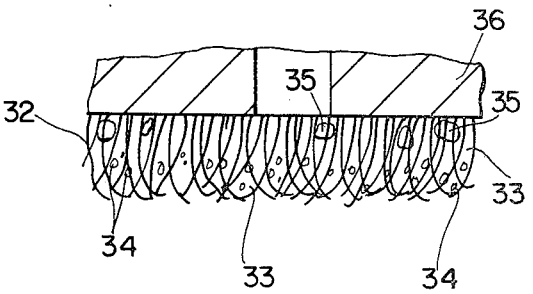
FIG. 4 is an enlarged diagrammatic view of a portion of the plating member of FIG. 3.

A plating member in accordance with the invention is shown in FIGS. 3 and 4. Plating member 30 includes a plating surface 31 adapted to be urged against and moved relative to an object surface for mechanically applying a metal coating on the surface. Plating surface 31 comprises a plurality of plating elements 32, preferably elongate metallic elements such as fibers or wires. Spaces 33 function between the plating elements to form a reservoir retaining particles 34 of metal to be plated on the object surface, the metal particles being present in an amount sufficient to effect plating of a substantial portion of the object surface. Plating members 30 may be pre-packaged with a supply of plating metal particles present and may be provided with some or all of the mechanical plating promoters selected for a particular use. A pre-packaged plating member of this type is preferably packaged in a protective wrapper of plastic, foil, or the like, particularly if the plating admixture carried by the member includes an evaporable liquid. In many instances it will be desirable to provide a plurality of plating members in kit form in which case the plating members in a kit may vary in size, shape, type of plating element, type of plating material, etc.

The plating elements are secured to a backing member 36 in any convenient way such as by embedding wire elements into member 36 similarly as in a wire brush. The elongate plating elements, however, are preferably matted down to facilitate retention of plating metal particles and other materials.

An absorbent material, such as sponge pieces 35 may be provided in the reservoir spaces to facilitate retention of liquids.

Member 36 is preferably attached, in use, to a rotating member, such as a drill chuck. For this purpose the plating member is provided with a shaft 37 extending rearwardly and generally normal to plating surface 31.

In some instance it is desirable to feed a supply of plating material to the plating member during operation of the device. This is disclosed, for example, in connection with FIG. 1. In order to facilitate a supply of plating material to the area of the plating surface 31, plating member 30 may be provided with channels 38 for supplying plating material from an external source of supply.

Figure 5:
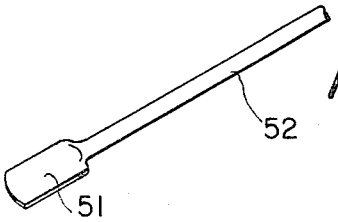
FIGS. 5 and 6 are enlarged diagrammatic views of plating elements in accordance with the invention.
Figure 6:
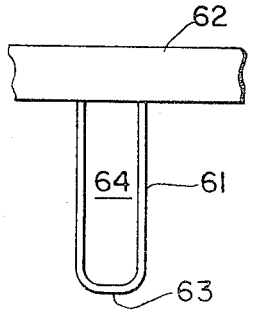

Metal fibers 32 may take various forms such as shown in FIGS. 5 and 6. As shown in FIG. 5, the distal end 51 of each wire 52 is flattened such that, in use, the broad side of the flattened area 51 can be pressed against the work surface. As mentioned above, a preferred form of plating member is formed of a mat or pad of tangled wires. However, many other configurations are suitable. The essential requirements are: (1) to provide a substantial void space to form a reservoir for liquid plating medium and metal plating particles; and (2) to hammer and cold weld the metal particles rapidly onto the surface to be coated at a high rate. Where wire brushes are used, the bristles may assume various configurations. For example, a "paper clip" or U-shaped configuration as shown in FIG. 6 is suitable. As shown therein, individual U-shaped "bristles" 61 (only one of which is shown) are secured to a base portion 62 of a plating member in any suitable manner. The bottom 63 of the "U" is the distal end of the bristle which is urged against the surface to be coated. It will be readily appreciated that the void space 64 between the "legs" of the U-shaped wire together with spaces between individual wires, provide a substantial void volume for the plating materials. Distal end 63 may be flattened similarly as described in connection with FIG. 5 to reduce abrasiveness. Irrespective of the type of bristles employed, they can be randomly or regularly arrayed. Of course, the plating elements need not be in the form of bristles. Other forms, such as a sponge-like pad, a textile-like pad, or the like having a substantial amount of void space as mentioned above, may be employed.

A closure member, such as a peripheral plastic wall member 39 may be provided around member 36 to retain plating material in the vicinity of plating surface 31.

A plating member containing plating metal particles in accordance with the inventor may be provided in a portable plating device such as shown in FIG. 1 in which case it is not necessary to supply metal plating particles from supply reservoir 13. Where the plating member is provided with all of the plating materials required for a particular task, or where the plating materials are otherwise supplied, supply reservoir 13 may be eliminated or filled with water of the like solely for the purpose of increasing the weight of the portable device during use. Reservoir 13 is provided with a conventional filler cap 40 for admitting water, plating materials, etc.

As mentioned above, the device may include means for retaining a supply of plating admixture adjacent the plating member surface in use. For example, a wall may be provided surrounding the mechanical plating member such as peripheral wall 23 in FIG. 1 and wall 39 in FIG. 3. The portion of such a retaining member which contacts the surface of the object to be plated is preferably fabricated of a material having a low coefficient of friction such that the device can be easily moved over the object surface.

In use, a portable plater in accordance with the invention is moved into operative position with the plating surface of the plating member urged against the object surface. An admixture of mechanical plating promoter and plating metal particles is then moved relative to its housing and relative to the object surface to provide a solid metallurgically integrated metallic coating derived from the plating metal particles onto the object surface. The device itself may also be moved relative to the object surface. The plating admixture may be supplied in any of the various ways described above such as from an external supply, from a supply carried by the device, from a supply provided in the plating member itself, from combinations of these arrangements. Moreover, some of the materials may be supplied in one way and others in another way. For example, all but the liquid ingredients may be pre-provided in a plating member and the member simply dipped into a liquid prior to use. Where the device is provided with the plurality of different types of plating members, the method may be interrupted, a plating member replaced by a different type of plating member, and the process then resumed. When the device is large, such as a device suitable for plating a bridge or other massive structures, the device may be provided with a motor or the like for moving the device over the surface to be plated. Thus, the device is portable in that it is transported to the work site and, after positioning adjacent a work surface, the device is moved by means of a drive motor that may be mounted on the device itself.

The term "plating surface" which is used herein refers to the surface of the mechanical plating member of the apparatus.

What is claimed is:

1. A method of mechanically applying a metal coating onto the surface of an object comprising:

providing a portable plating device comprising: a housing; a mechanical plating member moveable relative to said housing and having a plating surface adapted to be urged against and moved relative to said object surface; means for moving said plating member relative to said housing with said plating surface urged against said object surface; and means for holding and guiding said device for movement by an operator over said surface, said device being portable and capable of being moved to said object for plating thereof;

moving said device into operative position with said plating surface of said plating member urged against said object surface;

supplying an admixture of mechanical plating promoter and particles of plating metal to said plating surface; and moving said plating member relative to said housing and relative to said object surface to provide a solid metallurgically integrated metallic coating derived from said plating metal particles onto said surface.

2. A method according to claim 1 further comprising moving said device relative to said object surface while simultaneously moving said plating member relative to said object surface.

3. A method according to claim 2 wherein said admixture is supplied from a reservoir carried by said device.

4. A method according to claim 2 wherein said admixture is supplied to said device from an external source.

5. A method according to claim 2 wherein a component of said admixture is supplied from a reservoir carried by said device.

6. A method according to claim 2 wherein said plating surface of said mechanical plating member comprises a plurality of plating elements having spaces therebetween, said spaces forming a reservoir for retaining said admixture.

7. A method according to claim 6 wherein said plating elements are metallic.

8. A method according to claim 7 wherein said metallic plating elements comprise metal fibers.

9. A method according to claim 8 wherein said metal is at least one selected from the group consisting of zinc, steel, copper, brass and bronze.

10. A method according to claim 2 wherein said plating members are arranged in pairs, each plating member in a pair being in adjacency and comprising a plating surface rotatable in opposite directions.

11. A method according to claim 2 wherein the plating members are odd in number.

12. A method according to claim 2 wherein said metal to be plated is selected from the group consisting of copper, zinc, aluminum, lead, tin, silver and alloys thereof.

13. A method according to claim 2 wherein said plating member comprises absorbent material for retaining a liquid contained in said plating admixture.

14. A method according to claim 2 wherein said mechanical plating promoter comprises a synthetic resin.

15. A method according to claim 2 comprising the further steps of interrupting the metal plating process, replacing the plating member with a plating member of a different type, and continuing the metal plating process.

16. A method according to claim 15 wherein the different types of plating members are of different size.

17. A method according to claim 15 wherein the different types of plating members are of different shape.

18. A method according to claim 2 wherein said plating member is detachable from said device and is provided with a supply of said plating metal particles prior to attachment thereto.

19. A method according to claim 2 wherein said metal particles comprise metal ribbons, fibers or powder.

20. A method according to claim 2 wherein said plating member comprises a plurality of plating elements, said elements comprising stainless steel wires formed into U-shaped loops with the "U" portion outermost and forming said plating surface.

21. A method according to claim 2 wherein said plating promoter comprises an acid flux, a surfactant, and an organic lubricant.

22. A method according to claim 2 wherein said plating promoter comprises water and has an acid pH.

* * * * *